US009178273B2

(12) United States Patent
Mikami

(10) Patent No.: US 9,178,273 B2
(45) Date of Patent: Nov. 3, 2015

(54) ANTENNA INTEGRATED WITH SOLAR BATTERY

(71) Applicant: DENSO CORPORATION, Kariya, Aichi-pref. (JP)

(72) Inventor: Seishin Mikami, Toyota (JP)

(73) Assignee: DENSO CORPORATION, Kariya, Aichi-pref.

( * ) Notice: Subject to any disclaimer, the term of this patent is extended or adjusted under 35 U.S.C. 154(b) by 201 days.

(21) Appl. No.: 13/737,204

(22) Filed: Jan. 9, 2013

(65) Prior Publication Data

US 2013/0201063 A1 Aug. 8, 2013

(30) Foreign Application Priority Data

Feb. 3, 2012 (JP) ..... 2012-021804

(51) Int. Cl.

| | |
|---|---|
| ***H01Q 1/38*** | (2006.01) |
| ***H01Q 1/36*** | (2006.01) |
| ***H01Q 1/22*** | (2006.01) |
| ***H01Q 1/44*** | (2006.01) |
| ***H01Q 9/04*** | (2006.01) |
| ***H01Q 9/28*** | (2006.01) |

(52) U.S. Cl.

CPC . *H01Q 1/36* (2013.01); *H01Q 1/22* (2013.01); *H01Q 1/44* (2013.01); *H01Q 9/0407* (2013.01); *H01Q 9/285* (2013.01)

(58) Field of Classification Search

CPC ..... H01Q 1/36; H01Q 1/22; H01Q 1/44; H01Q 9/285; H01Q 9/0407

USPC ..... 343/897, 700 MS

See application file for complete search history.

(56) References Cited

U.S. PATENT DOCUMENTS

| | | | | |
|---|---|---|---|---|
| 8,373,613 | B2 * | 2/2013 | Lin et al. | 343/909 |
| 2003/0142018 | A1 * | 7/2003 | Lange | 343/700 MS |
| 2010/0188301 | A1 | 7/2010 | Kishimoto | |
| 2011/0227808 | A1 | 9/2011 | Takano et al. | |
| 2011/0237309 | A1 | 9/2011 | Shoji et al. | |
| 2012/0287017 | A1 * | 11/2012 | Parsche | 343/897 |

FOREIGN PATENT DOCUMENTS

| | | |
|---|---|---|
| CN | 1983718 A | 6/2007 |
| JP | 10-270925 | 10/1998 |
| JP | 11-163747 | 6/1999 |
| JP | 2001-320217 | 11/2001 |
| JP | 2009-206781 | 9/2009 |

OTHER PUBLICATIONS

Office Action issued Nov. 4, 2014 in corresponding JP Application No. 2012-21804 (with English translation).

Office Action dated Sep. 25, 2014 in corresponding CN Application No. 2013 1001 7490.1 (with English translation).

* cited by examiner

*Primary Examiner* — Dieu H Duong

(74) *Attorney, Agent, or Firm* — Harness, Dickey & Pierce, P.L.C.

(57) ABSTRACT

An antenna is integrated with a solar battery. The antenna has a radiation-element portion arranged above the solar battery. The radiation-element portion is made of metallic wire rods and formed in a net-like fashion.

9 Claims, 9 Drawing Sheets

ANTENNA INTEGRATED WITH SOLAR BATTERY

CROSS REFERENCE TO RELATED APPLICATION

This application is based on Japanese Patent Application No. 2012-021804 filed on Feb. 3, 2012, the disclosure of which is incorporated herein by reference.

TECHNICAL FIELD

The present disclosure relates to an antenna integrated with a solar battery.

BACKGROUND

An antenna integrated with a solar battery is known in the art, for example, as disclosed in Japanese Patent Publication No. H10-270925. The prior art antenna, which is composed of an electric-conductor film and an array-antenna element, is formed on a solar battery. The electric-conductor film of the antenna is made of metallic material, which is formed in a thin film. Since resistivity of the electric-conductor film is high, loss of the antenna as a whole is large. Antenna gain is thereby largely decreased.

SUMMARY OF THE DISCLOSURE

The present disclosure is made in view of the above points. It is an object of the present disclosure to provide an antenna integrated with a solar battery, according to which loss of the antenna can be reduced as a whole so as to improve antenna gain.

According to a feature of the present disclosure, an antenna integrated with a solar battery is composed of the solar battery and an antenna, wherein the antenna has a radiation-element portion above the solar battery. The radiation-element portion is made of metallic material and formed not in a thin film but in a net-like fashion. Resistivity of such radiation-element portion is not increased and loss of antenna can be made smaller as a whole. Accordingly, antenna gain is improved.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS (First Embodiment)

A first embodiment of the present disclosure will be explained with reference to FIGS. 1 to 5. A structure of an antenna, which is formed in a flat shape (so-called, a patch antenna), will be explained.

Figure 1A:
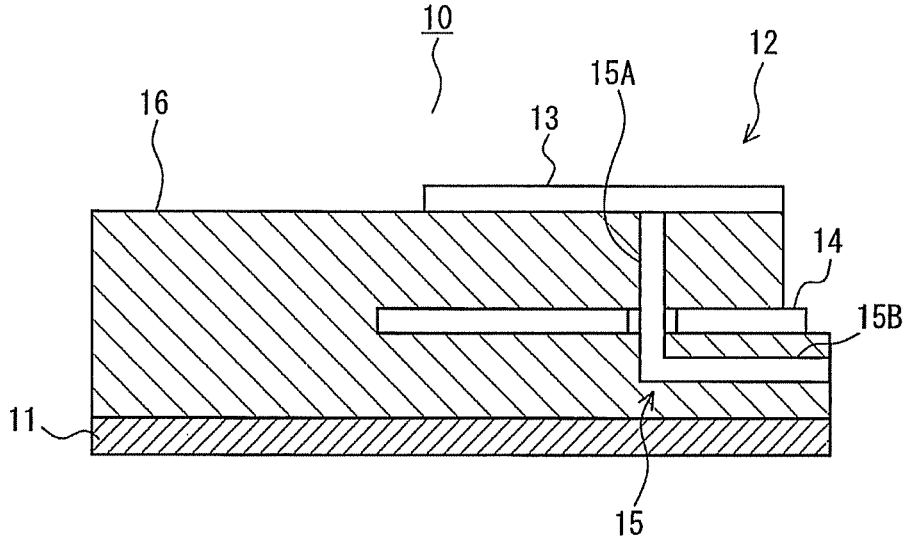
FIG. 1A is a schematic cross sectional view showing a structure of an antenna integrated with a solar battery according to a first embodiment of the present disclosure.

As shown in FIG. 1A, an antenna 10 integrated with a solar battery is composed of a solar battery 11 and a patch antenna 12.

Figure 1B:
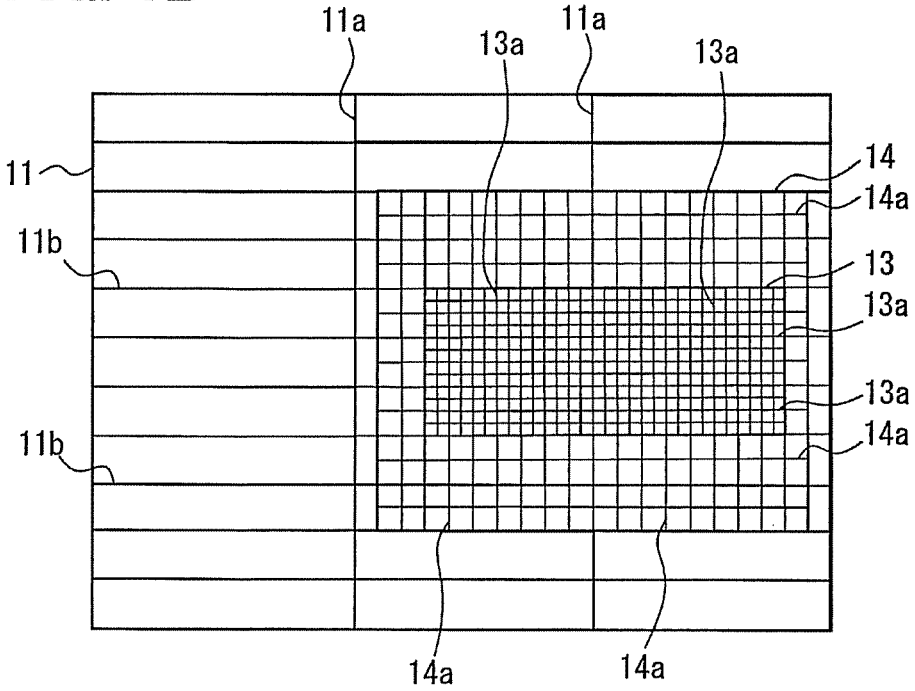
FIG. 1B is a schematic plane view showing the antenna integrated with the solar battery, in which a dielectric body is omitted from the drawing.

As shown in FIG. 1B, the solar battery 11 is formed in a rectangular shape, one of surfaces of which is directed in an upward direction. The solar battery 11 is composed of multiple bus-bar electrodes 11*a* and multiple grid lines 11*b* crossing with the bus-bar electrodes 11*a* at a right angle. In the solar battery 11, a power-generation cell receives sunlight to generate electric power, which is collected at the bus-bar electrodes 11*a* via the respective grid lines 11*b* and charged in a battery.

Figure 2:
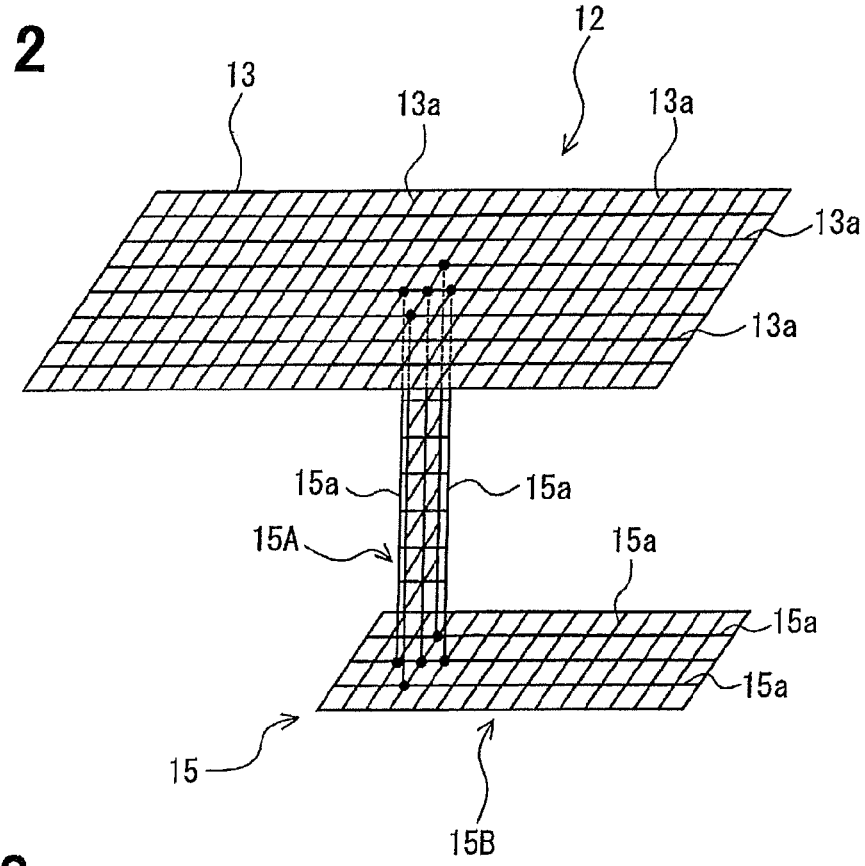
FIG. 2 is a schematic perspective view showing the structure of the antenna.
Figure 3:
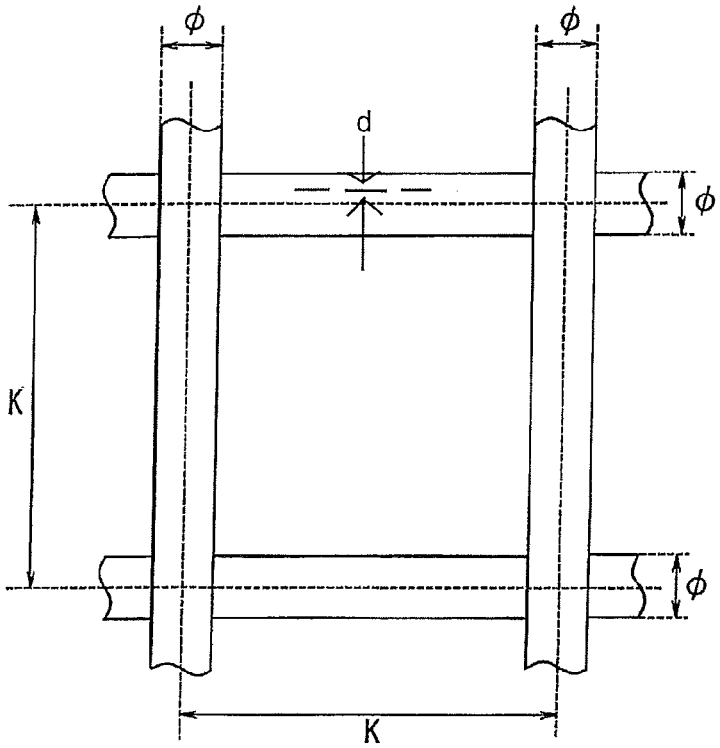
FIG. 3 is an enlarged schematic view showing a relevant portion of the antenna, in which wire rods cross with each other.

The patch antenna 12 has a radiation-element portion 13 arranged on an upper side of the solar battery 11. As shown in FIG. 1B and FIG. 2, the radiation-element portion 13 is made of fine metallic wire rods 13*a* and formed in a net-like fashion. The patch antenna 12 has a bottom-board portion 14 arranged above the solar battery 11. The bottom-board portion 14 is likewise made of fine metallic wire rods 14*a* and formed in a net-like fashion. The patch antenna 12 further has a feed-line portion 15 arranged above the solar battery 11 but below the bottom-board portion 14. As shown in FIG. 2, the feed-line portion 15 is likewise made of fine metallic wire rods 15*a* and formed in a net-like fashion. The feed-line portion 15 is composed of a vertical feed-line portion 15A extending in a vertical direction and a horizontal feed-line portion 15B extending in a horizontal direction.

The wire rods 13*a*, 14*a* and 15*a* of the radiation-element portion 13, the bottom-board portion 14 and the feed-line portion 15 overlap each other in the vertical direction. Furthermore, the wire rods 13*a*, 14*a* and 15*a* are arranged to overlap the bus-bar electrodes 11*a* and grid lines 11*b* in the vertical direction. The radiation-element portion 13, the bottom-board portion 14 and the feed-line portion 15 are supported by a transparent dielectric body 16. The dielectric body 16 is made of, for example, glass-based material or resin-based material. The dielectric body 16 has a rectangular outer shape, when viewed in the vertical direction. The outer shape of the dielectric body 16 coincides with the rectangular outer shape of the solar battery 11 in the vertical direction.

As shown in FIG. 2, each of the wire rods 15*a* of the vertical feed-line portion 15A is connected to respective wire rods 13*a* of the radiation-element portion 13, at each connecting point between the radiation-element portion 13 and the vertical feed-line portion 15A. In a similar manner, each of the wire rods 15*a* of the vertical feed-line portion 15A is connected to respective wire rods 15*a* of the horizontal feed-line portion 1513, at each connecting point between the vertical feed-line portion 15A and the horizontal feed-line portion 15B. Multiple wire rods 15*a* of the vertical feed-line portion 15A are arranged in a crosswise form, when viewed in the vertical direction.

A wire diameter "ϕ" (shown in FIG. 3) of each wire rod 13*a*, 14*a* and 15*a* is made to be larger than an epidermal depth "d" of each wire rod 13*a*, 14*a*, and 15*a* at a usable frequency for the patch antenna 12. The epidermal depth "d [m]" can be obtained by the following formula 1:

$$d=\sqrt{(2/\omega\cdot\mu\cdot\rho)} \quad \text{<Formula 1>}$$

ω: 2 π f f: usable frequency [Hz] for the antenna

μ: magnetic permeability [H/m]

ρ: electric conductivity [S/m]

For example, in a case that the usable frequency "f" for the antenna is "$100\times10^6$ [Hz]", the magnetic permeability "μ" of the wire rod is "$4\pi\times10^{-7}$ [H/m]", and the electric conductivity "ρ" of the wire rod (cupper) is "$58\times10^6$ [S/m]", then the epidermal depth becomes "$6.6\times10^{-6}$ [m]".

Each of intervals "K" (shown in FIG. 3) between the respective wire rods 13*a*, 14*a* and 15*a* is decided so as to meet the following formula 2:

$$K=\lambda/N \quad \text{<Formula 2>}$$

λ: wavelength [m] obtained from the usable frequency for the antenna,

N: a number of division for one wavelength

As above, each of the respective intervals "K" is set as a value smaller than the wavelength "λ" obtained from the usable frequency of the antenna.

The number "N" of division for one wavelength indicates a number of divided parts of the waveform for one wavelength, wherein one wavelength "λ" is divided into several parts by multiple wire rods included in a range of one wavelength. In other words, the number "N" of division for one wavelength is related to a number of wire rods included in the range of the one wavelength.

Figure 4A:
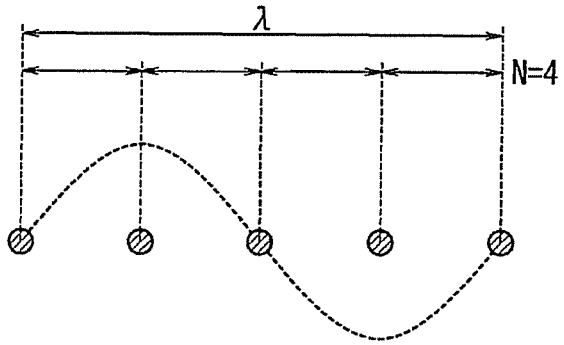
FIGS. 4A to 4C are schematic views for explaining relationship between a number of the wire rods included in one wavelength and a number of division for one wavelength.
Figure 4B:
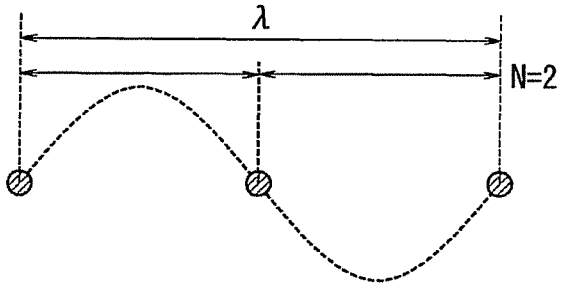
Figure 4C:
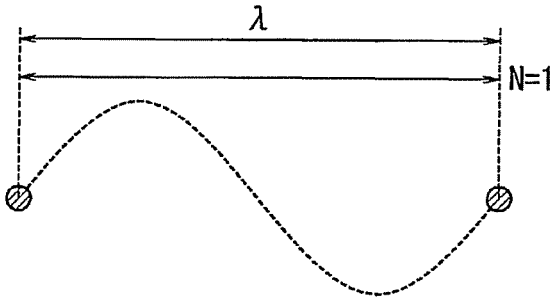

For example, as shown in FIG. 4A, when the number of the wire rods is 5 (five) included in one wavelength, the number "N" of division becomes 4 (four). In a case that the number of the wire rods is 3 (three), as shown in FIG. 4B, the number "N" of division becomes 2 (two). Furthermore, as shown in FIG. 4C, when there are 2 (two) wire rods in the range of the one wavelength, the number "N" of division is 1 (one).

The interval "K" between the neighboring wire rods becomes larger, as the number of the wire rods included in the range of the one wavelength becomes smaller. For example, in a case that the usable frequency for the patch antenna 12 is "100 [MHz]", and speed of light is "$3\times10^8$ [m/s]", the wavelength "λ" is calculated by the "$3\times10^8$ [m/s]"/"100 [MHz]". As a result, the wavelength "λ" becomes "3 [m]".

In the above explained structure, since the dielectric body 16 is provided between the bottom-board portion 14 and the horizontal feed-line portion 15B (a portion of the feed-line portion 15), a structure for a microstrip-transmission path is formed. Radio wave, which is transmitted or received via the radiation-element portion 13, is sent from or sent to an electric circuit (not shown) via the structure for the microstrip-transmission path.

A relationship between the number "N" of division for the one wavelength and transmissivity "T" of sunlight through the patch antenna 12 will be explained with reference to FIG. 5.

Figure 5:
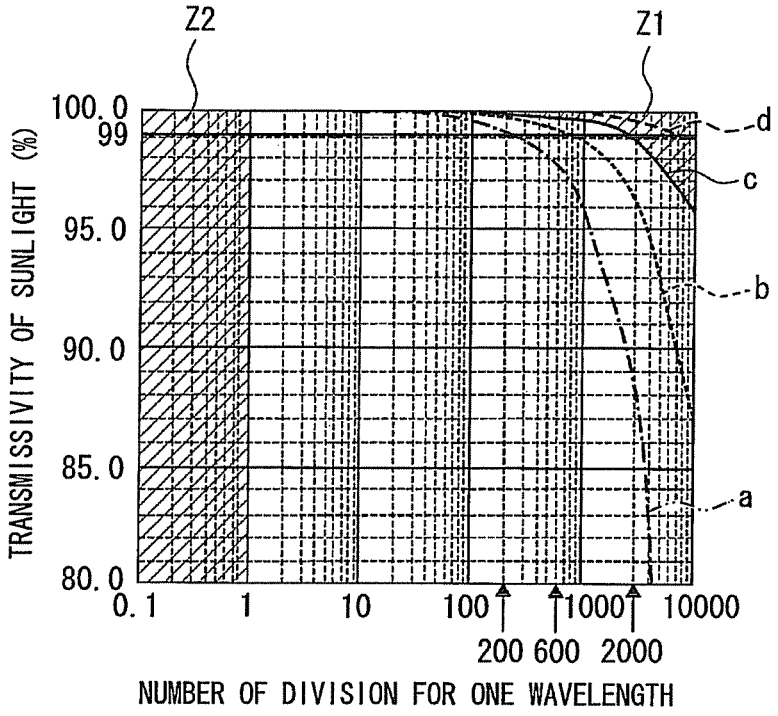
FIG. 5 is a graph showing relationship between the number of division for one wavelength and transmissivity of sunlight with respect to the antenna.

FIG. 5 shows an example of a case, according to which the material for the wire rod is cupper (ρ=$58\times10^6$ [S/m]) and the usable frequency "f" is 100 [MHz] . The wire diameter "ϕ" for each characteristic curve indicated by a letter "a", "b" or "c" is larger than (or equal to) the epidermal depth "d". More exactly, the letter "a" shows a case in which the wire diameter "ϕ" for the wire rod is larger than the epidermal depth "d" by ten (10.0) times. The letter "b" shows a case in which the wire diameter "ϕ" for the wire rod is larger than the epidermal depth "d" by three (3.0) times. The letter "c" shows a case in which the wire diameter "ϕ" for the wire rod is larger than the epidermal depth "d" by one (1.0) times. A letter "d" shows a case in which the wire diameter "ϕ" for the wire rod is larger than the epidermal depth "d" by 0.3 times. In other words, it shows the case in which the wire diameter "ϕ" for the wire rod is smaller than the epidermal depth "d".

In FIG. 5, a hatched area Z1 indicates an area in which the wire diameter "ϕ" for the wire rod is smaller than the epidermal depth "d". A performance of the patch antenna 12 is extremely decreased in this area Z1. Another hatched area Z2 indicates such an area, in which the number "N" of division for the one wavelength is smaller than "1". In other words, the number of the wire rods included in the range of the one wavelength becomes smaller than 2, so that the interval "K" between the wire rods becomes larger than the wavelength "λ". Therefore, the performance of the patch antenna 12 is also extremely decreased in this area Z2.

The transmissivity "T (%)" of sunlight indicates a degree of the sunlight passing through the patch antenna 12, which can be obtained by the following formula 3:

$$T=((K-\phi)^2/K^2)\times100 \quad \text{<Formula 3>}$$

As shown in FIG. 5, in the case indicated by the letter "a", the interval "K" between the wire rods becomes sufficiently large, when the number "N" of the division for the one wavelength is smaller than 200, so that the transmissivity "T (%)" of sunlight becomes a value larger than 99 (%). In the case indicated by the letter "b", the interval "K" between the wire rods becomes sufficiently large, when the number "N" of the division for the one wavelength is smaller than 600, so that the transmissivity "T (%)" of sunlight becomes a value larger than 99 (%). In the case indicated by the letter "c", the interval "K" between the wire rods becomes sufficiently large, when the number "N" of the division for the one wavelength is smaller than 2000, so that the transmissivity "T (%)" of sunlight becomes a value larger than 99 (%).

In the case indicated by the letter "d", namely in the case that the wire diameter "ϕ" for the wire rod is smaller than the epidermal depth "d", the transmissivity "T (%)" of sunlight is expected to become a value larger than 99 (%), when the number "N" of the division for the one wavelength is smaller than 5000. However, since the case of the letter "d" is included in the area Z1 (in which the wire diameter "ϕ" is smaller than the epidermal depth "d"), the performance of the patch antenna 12 is extremely decreased. Namely, the antenna 12 can not sufficiently bring out the function for the antenna.

According to the present embodiment, as explained above, the antenna integrated with the solar battery has the solar battery 11 and the patch antenna 12, wherein the patch antenna 12 has the radiation-element portion 13 arranged above the solar battery 11. The radiation-element portion 13 is made of metallic material, which is formed not in the thin film but in the net-like fashion by wire rods 13*a*. In the radiation-element portion 13 of such structure, resistivity is not increased too much, and thereby loss of the patch antenna 12 as a whole can be made smaller. Accordingly, the antenna gain can be improved.

In addition, the bottom-board portion 14, which is arranged above the solar battery 11 and forms a part of the patch antenna 12, is made of the metallic wire rods 14*a* in the net-like fashion. Furthermore, the feed-line portion 15, which is also arranged above the solar battery 11 and forms a part of the patch antenna 12, is made of the metallic wire rods 15*a* in the net-like fashion. The resistivity for the bottom-board portion 14 and the resistivity for the feed-line portion 15 are not increased. The loss of the patch antenna 12 is thereby made smaller as a whole to thereby further improve the gain for the patch antenna.

The radiation-element portion 13, the bottom-board portion 14 and the feed-line portion 15 are arranged above the solar battery 11 and the wire rods 13*a*, 14*a* and 15*b* are arranged to overlap each other in the vertical direction. According to such a structure, those portions 13, 14 and 15 do not largely block out the sunlight reaching to the solar battery 11, so that the solar battery 11 can effectively and sufficiently receive the sunlight.

In addition, since the radiation-element portion 13, the bottom-board portion 14 and the feed-line portion 15 are supported by the transparent dielectric body 16, the transmissivity of the sunlight reaching to the solar battery 11 is not adversely affected. The radiation-element portion 13, the bottom-board portion 14 and the feed-line portion 15 are stably and firmly supported by the dielectric body 16.

The outer shape of the dielectric body 16 coincides with the outer shape of the solar battery 11 in the vertical direction. The upper side surface of the solar battery 11 is not directly exposed to the outside. In other words, the upper side surface of the solar battery 11 is protected by the antenna 12 arranged on the solar battery 11.

In addition, the wire dimension "ϕ" for the respective wire rods 13*a*, 14*a* and 15*a* is made to be larger than the epidermal depth "d", which is obtained from the usable frequency "f" of the patch antenna 12. The interval "K" between the neighboring wire rods 13*a*, 14*a* and 15*a* is made to be smaller than the wavelength "λ", which is also obtained from the usable frequency "f" of the patch antenna 12. The performance of the patch antenna 12 is not decreased, so that the patch antenna 12 can effectively bring out its function.

The respective wire rods 13*a*, 14*a* and 15*a* are so arranged as to overlap the bus-bar electrodes ha and the grid lines 11*b* in the vertical direction. The wire rods 13*a*, 14*a* and 15*a* do not largely block out the sunlight reaching to the solar battery 11. In other words, amount of the sunlight which is blocked out by the wire rods 13*a*, 14*a* and 15*a* can be minimized, so that the solar battery 11 can sufficiently receive the sunlight.

(Second Embodiment)

Figure 6A:
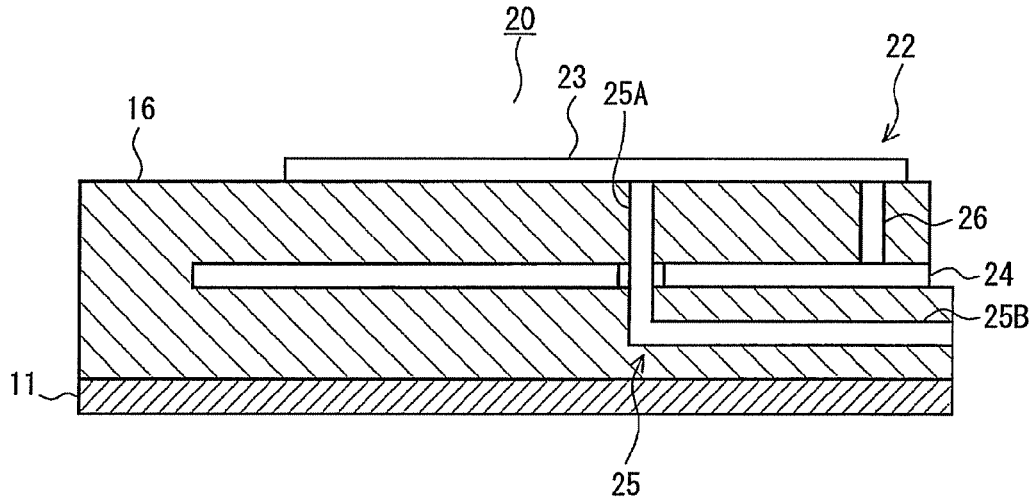
FIGS. 6A and 6B are a cross sectional view and a plane view, each schematically showing an antenna integrated with a solar battery according to a second embodiment of the present disclosure.
Figure 6B:
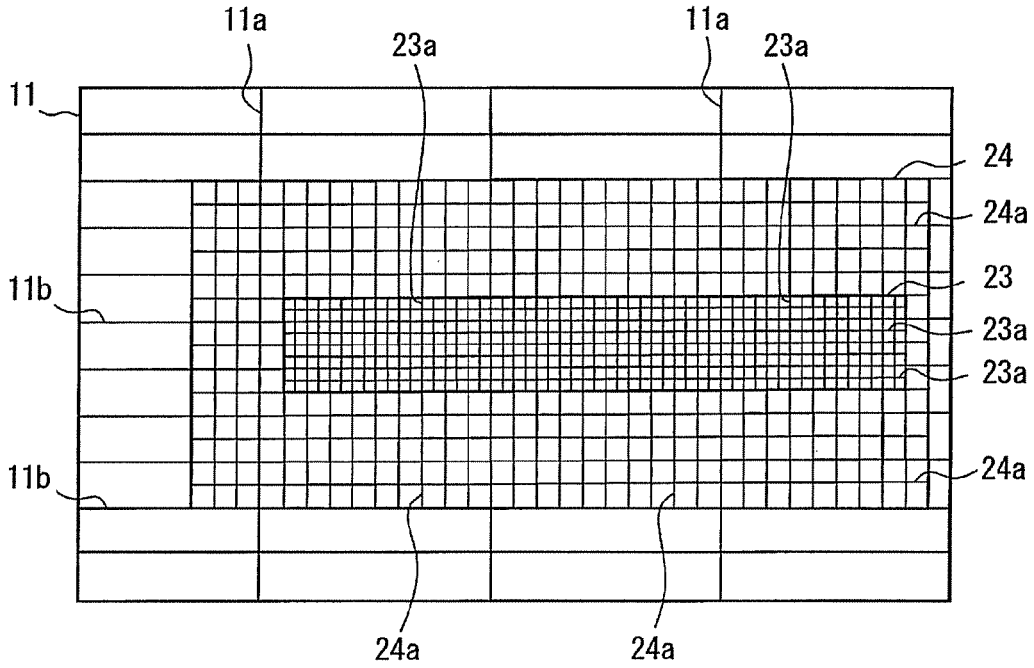

A second embodiment of the present disclosure will be explained with reference to FIGS. 6A and 6B. As shown in FIG. 6A, an antenna 20 integrated with a solar battery has an inverse-F-type antenna 22 in place of the patch antenna 12.

The inverse-F-type antenna 22 has a radiation-element portion 23 arranged on the upper side of the solar battery 11. As shown in FIG. 6B, the radiation-element portion 23 is made of fine metallic wire rods 23*a* and formed in a net-like fashion. The inverse-F-type antenna 22 has a bottom-board portion 24 arranged above the solar battery 11. As shown in FIG. 6B, the bottom-board portion 24 is likewise made of fine metallic wire rods 24*a* and formed in a net-like fashion. The inverse-F-type antenna 22 further has a feed-line portion 25 arranged above the solar battery 11 but below the bottom-board portion 24. The feed-line portion 25 is likewise made of fine metallic wire rods (not shown) and formed in a net-like fashion. The feed-line portion 25 is composed of a vertical feed-line portion 25A extending in the vertical direction and a horizontal feed-line portion 25B extending in the horizontal direction. The inverse-F-type antenna 22 further has a connecting line portion 26 for connecting one end of the radiation-element portion 23 to the bottom-board portion 24. Although not shown in the drawing, the connecting line portion 26 is likewise made of fine metallic wire rods and formed in a net-like fashion.

According to the second embodiment, the radiation-element portion 23 (which is a part of the inverse-F-type antenna 22) is made of the fine metallic wire rods 23*a* and formed in the net-like fashion. Since resistivity of the radiation-element portion 23 is not increased too much, and thereby loss of the inverse-F-type antenna 22 as a whole can be made smaller. Accordingly, the antenna gain can be improved. In addition, since the bottom-board portion 24, the feed-line portion 25 and the connecting line portion 26 (which are components for the inverse-F-type antenna 22) are formed in the net-like fashion by the fine metallic wire rods, the loss of the inverse-F-type antenna 22 can be made smaller as a whole and thereby the antenna gain can be further improved.

(Third Embodiment)

Figure 7A:
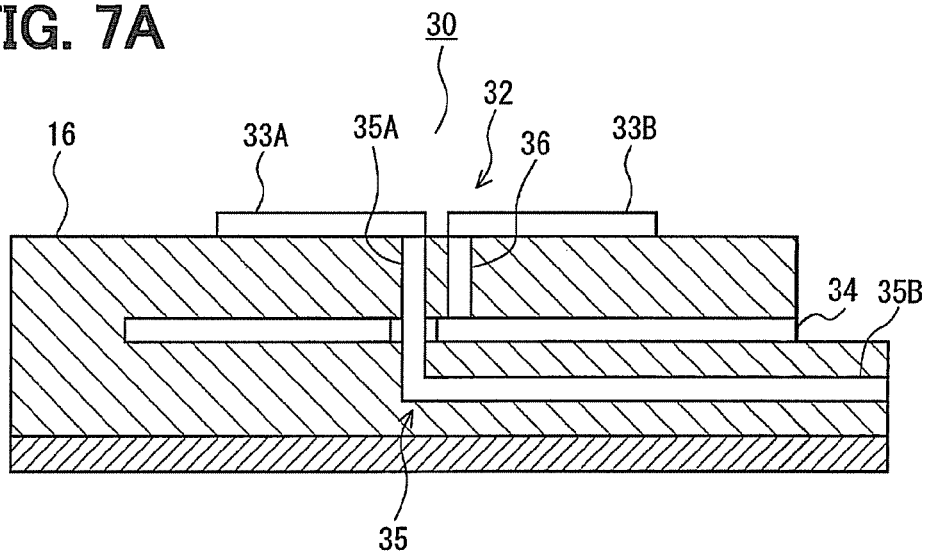
FIGS. 7A and 7B are a cross sectional view and a plane view, each schematically showing an antenna integrated with a solar battery according to a third embodiment of the present disclosure.
Figure 7B:
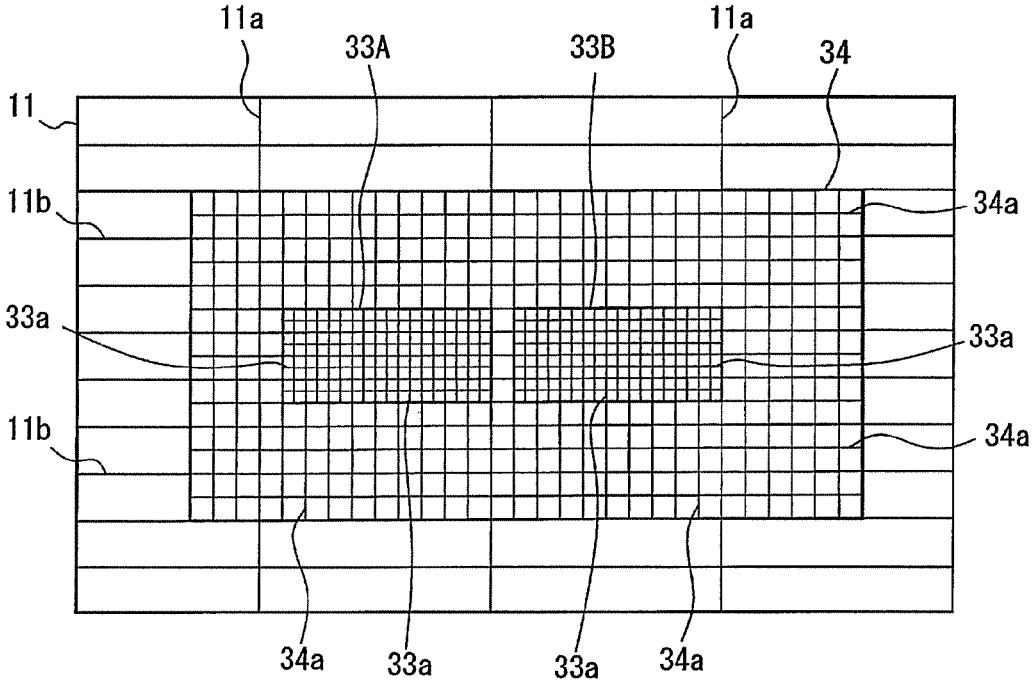

A third embodiment of the present disclosure will be explained with reference to FIGS. 7A and 7B. As shown in FIG. 7A, an antenna 30 integrated with a solar battery has a dipole antenna 32 in place of the patch antenna 12.

The dipole antenna 32 has a pair of radiation-element portions 33A and 33B arranged above the upper side of the solar battery 11. As shown in FIG. 7B, each of the radiation-element portions 33A and 33B is made of fine metallic wire rods 33*a* and formed in a net-like fashion. The dipole antenna 32 has a bottom-board portion 34 arranged above the solar battery 11. As shown in FIG. 7B, the bottom-board portion 34 is likewise made of fine, metallic wire rods 34*a* and formed in a net-like fashion. The dipole antenna 32 further has a feed-line portion 35 arranged above the solar battery 11 but below the bottom-board portion 34. The feed-line portion 35 is likewise made of fine metallic wire rods (not shown) and formed in a net-like fashion. The feed-line portion 35 is composed of a vertical feed-line portion 35A extending in the vertical direction and a horizontal feed-line portion 35B extending in the horizontal direction. The dipole antenna 32 further has a connecting line portion 36 for connecting one end of the radiation-element portion 33B to the bottom-board portion 34. Although not shown in the drawing, the connecting line portion 36 is likewise made of fine metallic wire rods and formed in a net-like fashion.

As in the same manner to the first and second embodiment, the radiation-element portions 33A and 33B (which are parts of the dipole antenna 32) are made of the fine metallic wire rods 33*a* and formed in the net-like fashion in the third embodiment. Since resistivity of the radiation-element portions 33A and 33B is not increased too much, and thereby loss of the dipole antenna 32 as a whole can be made smaller. In addition, since the bottom-board portion 34, the feed-line portion 35 and the connecting line portion 36 (which are components for the dipole antenna 32) are formed in the net-like fashion by the fine metallic wire rods, the loss of the dipole antenna 32 can be made smaller as a whole and thereby the antenna gain can be further improved.

(Further Embodiments and/or Modifications)

The present disclosure should not be limited to the above embodiments but can be modified in various ways without departing from the spirit of the present disclosure. For example, the following modifications can be made.

Figure 8A:
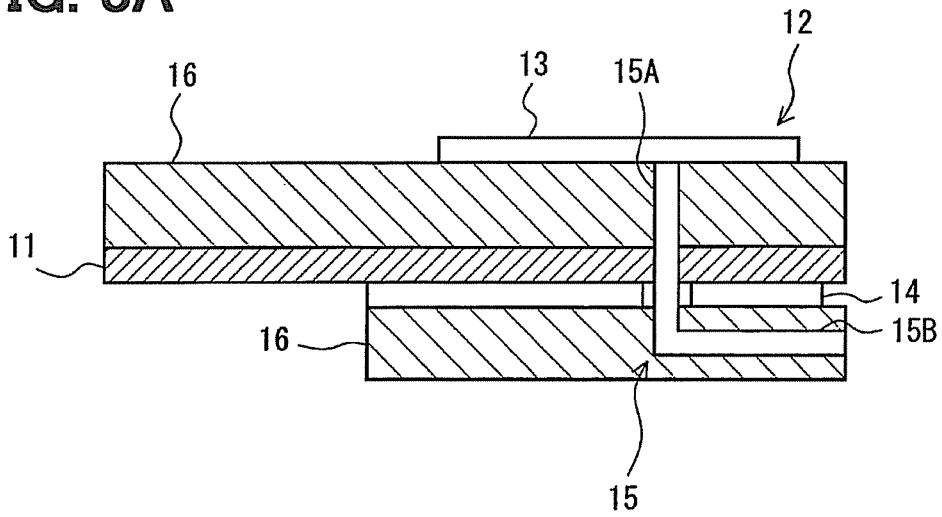
FIGS. 8A and 8B are a cross sectional view and a plane view, each schematically showing a modification of the first embodiment.
Figure 8B:
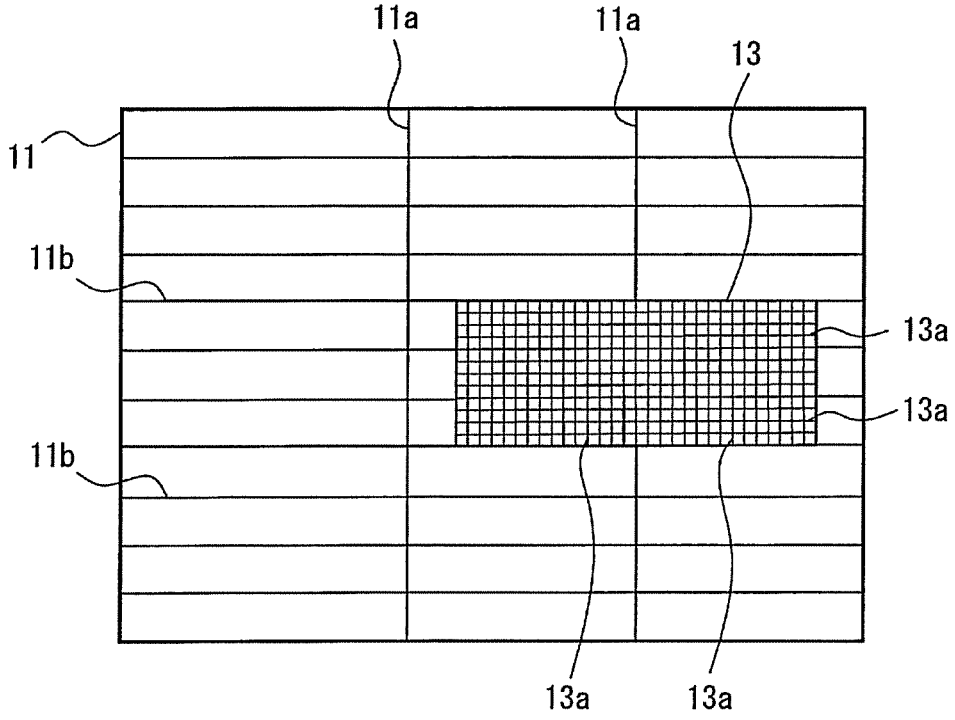
Figure 9A:
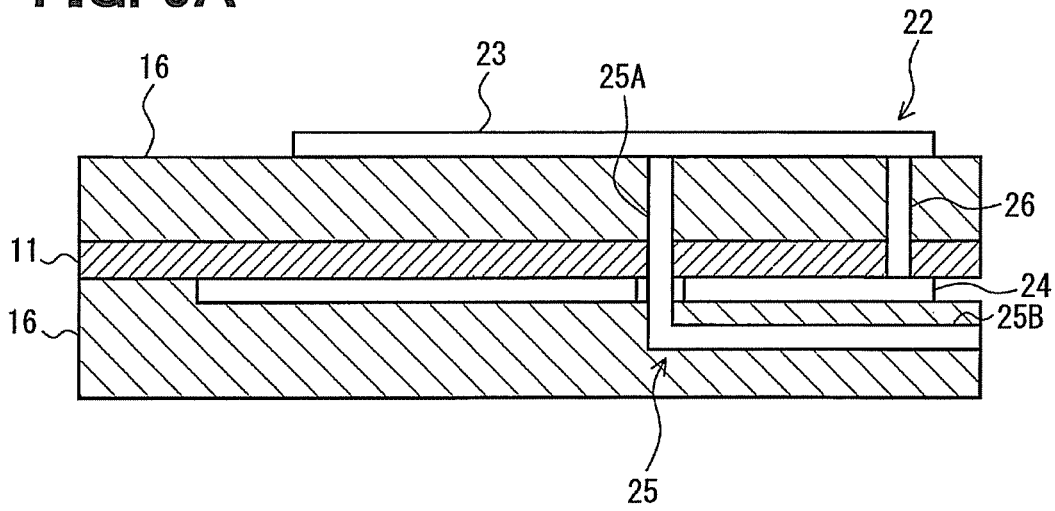
FIGS. 9A and 9B are a cross sectional view and a plane view, each schematically showing a modification of the second embodiment.
Figure 9B:
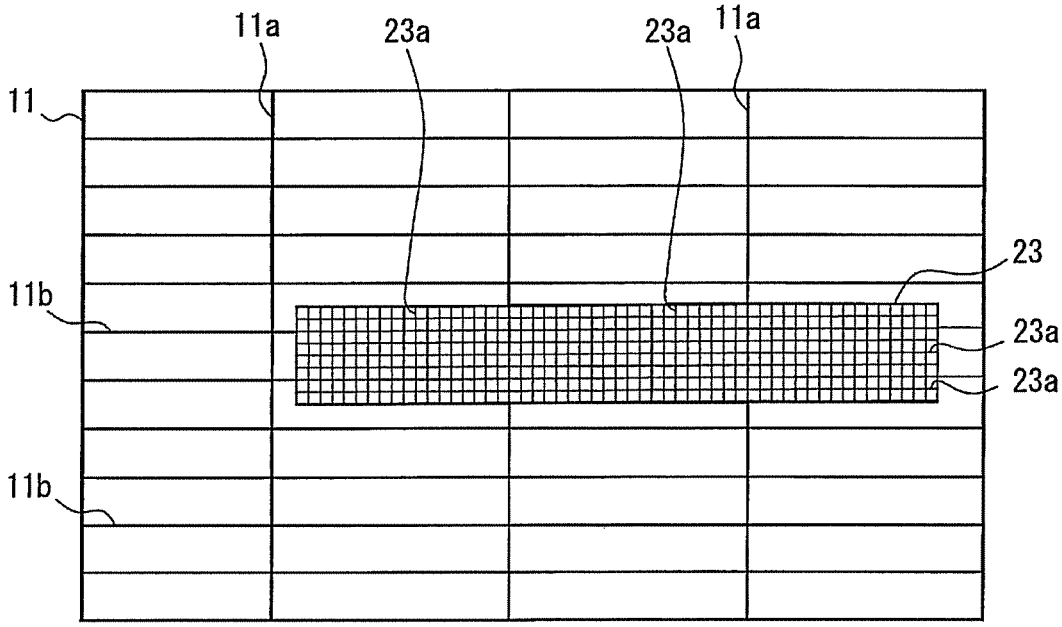
Figure 10A:
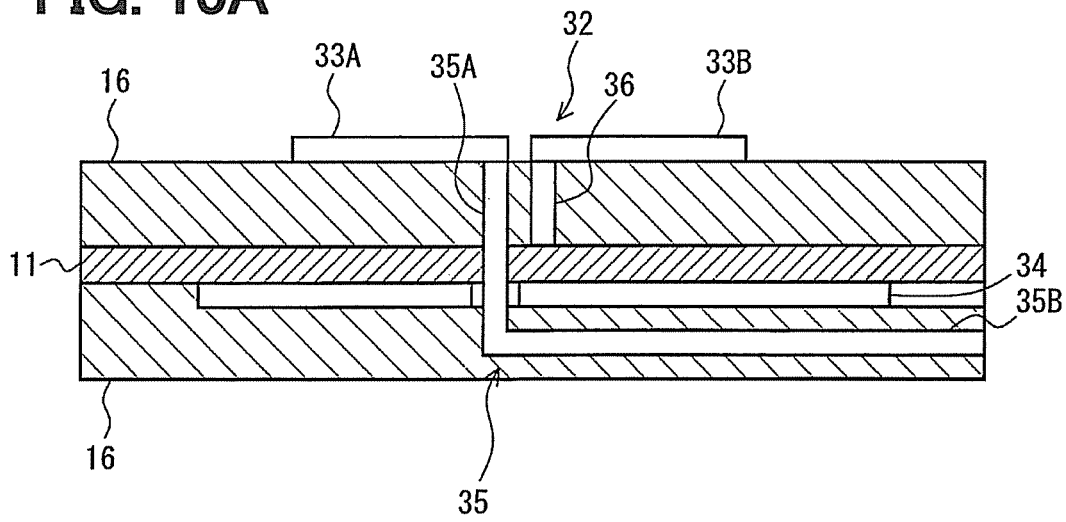
FIGS. 10A and 10B are a cross sectional view and a plane view, each schematically showing a modification of the third embodiment.
Figure 10B:
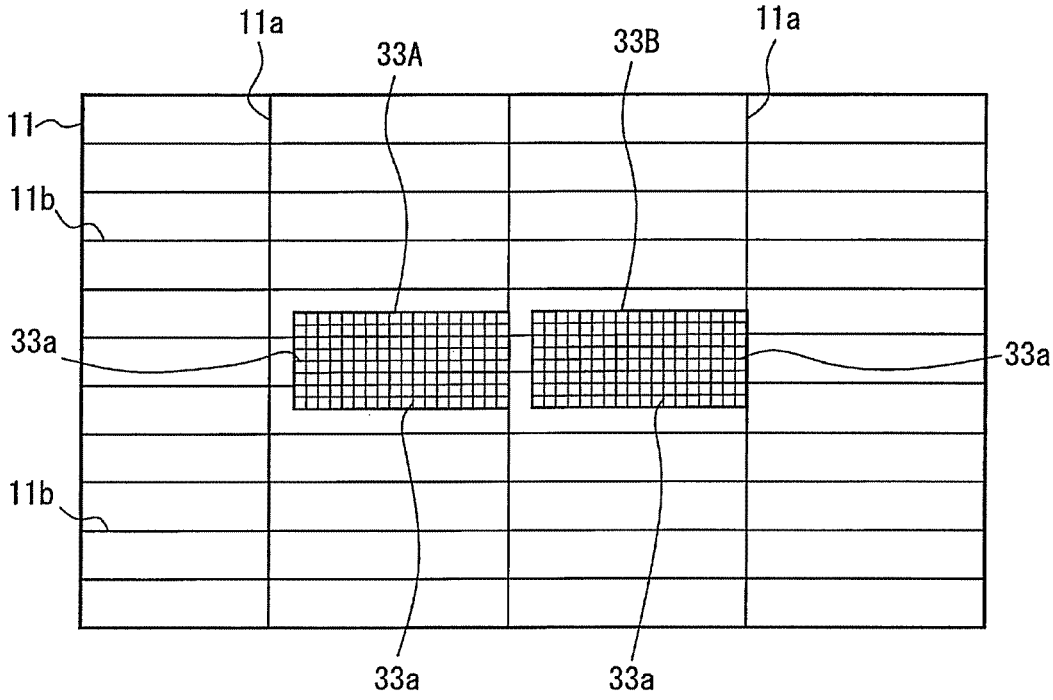

The bottom-board portion and the feed-line portion may be formed not above the solar battery but below the solar battery. For example, FIGS. 8A and 8B show a modification of the first embodiment, according to which the bottom-board portion 14 and the horizontal feed-line portion 15B (a part of the feed-line portion 15) are arranged below the solar battery 11. FIGS. 9A and 913 show a modification of the second embodiment, according to which the bottom-board portion 24 and the horizontal feed-line portion 25B (a part of the feed-line portion 25) are arranged below the solar battery 11. FIGS. 10A and 10B show a modification of the third embodiment, according to which the bottom-board portion 34 and the horizontal feed-line portion 35B (a part of the feed-line portion 35) are arranged below the solar battery 11. According to the above modifications, only the radiation-element(s) 13, 23, 33A and 33B of the respective antennas 12, 22 and 32 are arranged above the solar battery 11. The amount of the sunlight, which will be blocked out by the components of the antenna, can be further reduced, to thereby increase the amount of the sunlight to be received by the solar battery 11.

According to the present disclosure, the components for the antenna are made of multiple fine wire rods and formed in the net-like fashion. The antenna can be easily, formed in any desired shape, so as to bring out an appropriate antenna performance.

The above embodiments and modifications can be combined to each other in the present disclosure.

What is claimed is:

1. An antenna integrated with a solar battery comprising:

the solar battery;

an antenna having a radiation-element portion arranged above an upper side of the solar battery;

a bottom-board portion arranged between the radiation-element portion and the solar battery in the vertical direction of the antenna; and a feed-line portion having a vertical feed-line portion and a horizontal feed-line portion, the horizontal feed-line portion being arranged between the bottom-board portion and the solar battery in the vertical direction of the antenna; wherein the radiation-element portion is made of metallic wire rods and formed in a net-like fashion;

the wire rods are arranged to overlap an area for bus-bar electrodes and grid lines of the solar battery in a vertical direction of the antenna;

each of the wire rods is arranged parallel to the bus-bar electrodes or the grid lines when viewed in the vertical direction of the antenna;

the bottom-board portion is made of metallic wire rods and formed in a net-like fashion, each of the wire rods of the bottom-board portion is arranged parallel to the bus-bar electrodes or the grid lines when viewed in the vertical direction of the antenna;

the horizontal feed-line portion of the feed-line portion is made of metallic wire rods and formed in a net-like fashion, and each of the wire rods of the horizontal feed-line portion is arranged parallel to the bus-bar electrodes or the grid lines when viewed in the vertical direction of the antenna.

2. The antenna according to claim 1, wherein the wire rods for the radiation-element portion and the wire rods for the bottom-board portion overlap each other in the vertical direction of the antenna.

3. The antenna according to claim 1, wherein the wire rods for the radiation-element portion, the wire rods for the bottom-board portion and the wire rods for the horizontal feed-line portion overlap one another in the vertical direction of the antenna.

4. The antenna according to claim 1, wherein the radiation-element portion and the bottom-board portion are supported by a transparent dielectric body.

5. The antenna according to claim 4, wherein the dielectric body has an outer shape, which coincides with that of the solar battery in a vertical direction of the antenna.

6. The antenna according to claim 1, wherein the radiation-element portion, the bottom-board portion and the feed-line portion are supported by a transparent dielectric body.

7. The antenna according to claim 1, wherein a wire diameter of the wire rods is made to be larger than an epidermal depth of the wire rods at a usable frequency for the antenna.

8. The antenna according to claim 1, wherein an interval between the wire rods is made to be smaller than a wavelength of a usable frequency for the antenna.

9. The antenna according to claim 1, wherein each of the wire rods is arranged parallel to both the bus-bar electrodes and the grid lines when viewed in the vertical direction of the antenna.

* * * * *